US005478612A

United States Patent [19]

Hack et al.

[11] Patent Number: 5,478,612

[45] Date of Patent: Dec. 26, 1995

[54] DECORATIVE GOLF BALL WITH MAGNET INSERT

[76] Inventors: Robert F. Hack; Robert K. Hack, both of 1831 9th St., Bay City, Mich. 48708

[21] Appl. No.: 275,351

[22] Filed: Jul. 15, 1994

[51] Int. Cl.[6] ..... H01F 1/00

[52] U.S. Cl. ..... 428/11; 428/187; 428/900

[58] Field of Search ..... 428/11, 900, 7, 428/187; D21/204, 205; 273/62; 156/146

[56] References Cited

U.S. PATENT DOCUMENTS

| | | | |
|---|---|---|---|
| D. 29,532 | 10/1898 | Woglom | D19/97 |
| D. 75,220 | 5/1928 | Dahlstrom | D19/97 |
| D. 101,708 | 10/1936 | Nadvornik | D19/77 |
| D. 194,688 | 2/1963 | Santora | D21/204 |
| D. 279,300 | 6/1985 | Wolf | D19/97 |
| D. 326,114 | 5/1992 | Murtagh | D19/97 |
| D. 330,524 | 10/1992 | Goserud | D19/97 X |
| 3,879,876 | 4/1975 | Morgan | 428/11 X |
| 4,178,707 | 12/1979 | Littlefield | 428/900 X |
| 5,184,970 | 2/1993 | Binkley | 446/132 |

FOREIGN PATENT DOCUMENTS

| | | | |
|---|---|---|---|
| 43-26054 | 11/1968 | Japan | 273/213 |

OTHER PUBLICATIONS

Page 180 Miles Kimball Co. Fall Catalogue 1974.

*Primary Examiner*—Henry F. Epstein
*Attorney, Agent, or Firm*—Shlesinger, Arkwright & Garvey

[57] ABSTRACT

A decorative device comprises a golf ball including a recess; a plug with an exposed flat surface disposed within the recess such that the golf ball can be placed on flat surface without rolling off.

7 Claims, 2 Drawing Sheets

FIG. 1
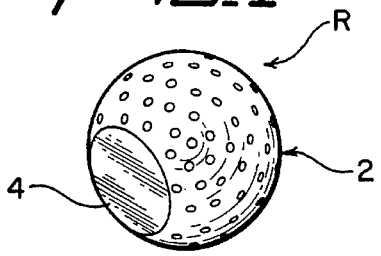
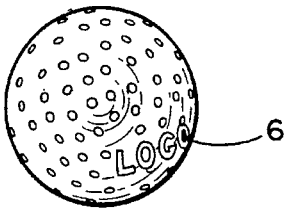
FIG. 2
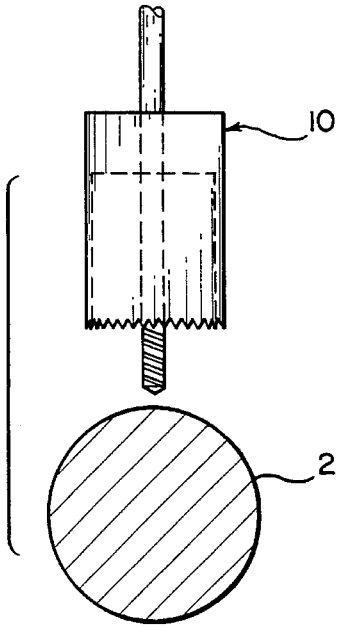
FIG. 3
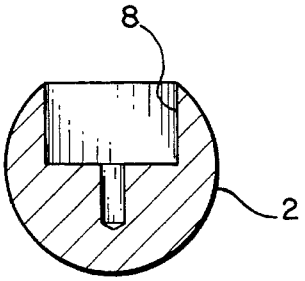
FIG. 4
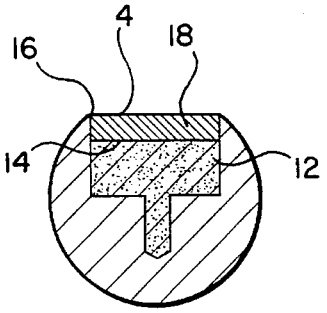
FIG. 5
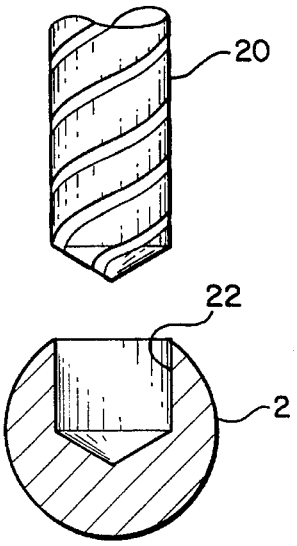
FIG. 6
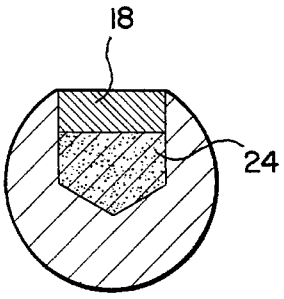
FIG. 7
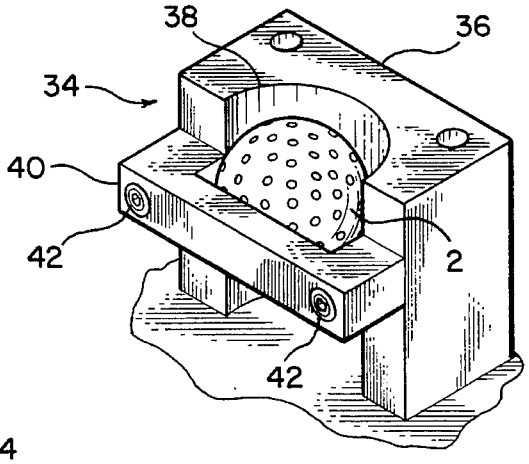
FIG. 11

FIG. 8
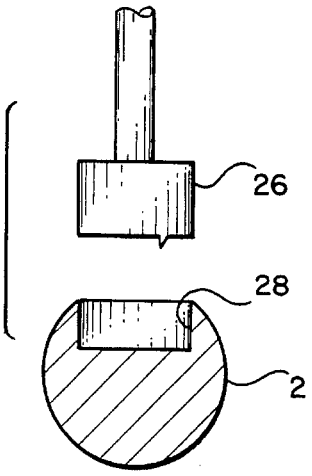
FIG. 9
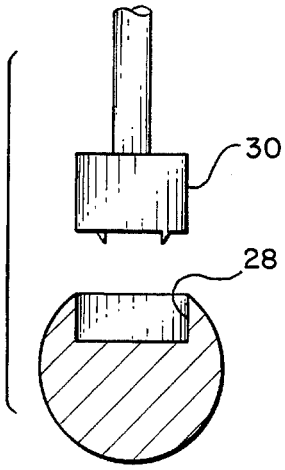
FIG. 10
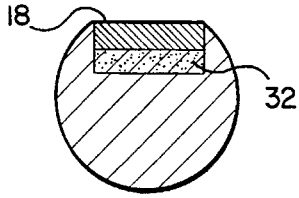
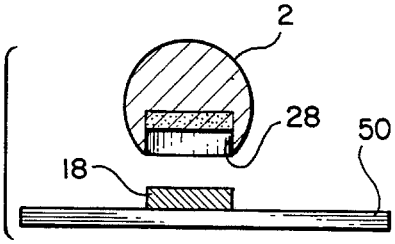
FIG. 13
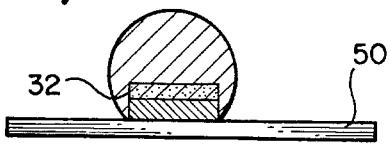
FIG. 14
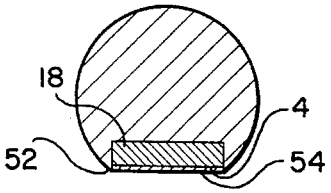
FIG. 15
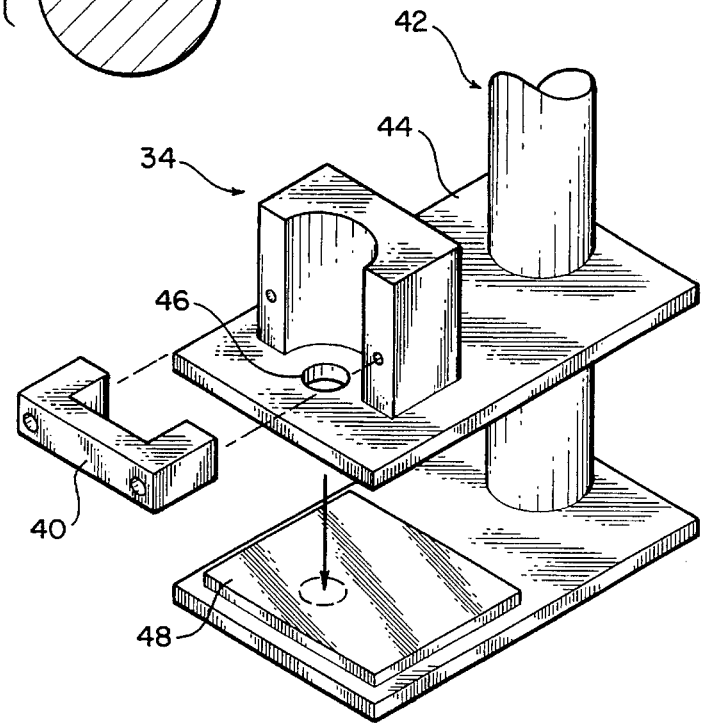
FIG. 12
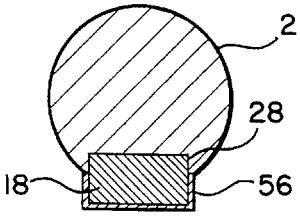
FIG. 16
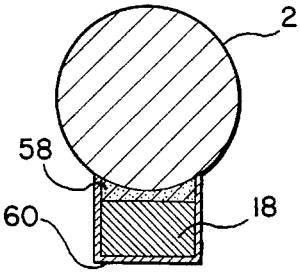
FIG. 17
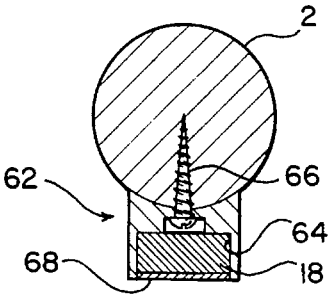
FIG. 18

DECORATIVE GOLF BALL WITH MAGNET INSERT

FIELD OF THE INVENTION

The present invention generally relates to a decorative article and particularly to a golf ball with a magnet insert to enable the golf ball to sit on a horizontal or magnetic vertical surface without rolling off.

BACKGROUND OF THE INVENTION

There might be a strong desire on the part of one golfer who has just shot a hole-in-one, a "birdie" or other crucial shot to keep and display the ball for everyone to see. However, there is no device currently available that will allow the person to display his cherished ball in the open. Consequently, the ball most likely would end up in a drawer and be forgotten.

There may be other needs to display golf balls in the open, such as in a store, wherein their brand names, trademarks, logos, etc. are prominently displayed.

There is therefore a need for a means for displaying a golf ball in the open in such a manner that the golf ball does not roll off and presents prominently its company logo, trademark, brand name, etc for advertising purposes and the like.

OBJECTS AND SUMMARY OF THE INVENTION

It is an object of the present invention to provide a decorative golf ball that can be removably secured to metallic surfaces or on flat surfaces without falling or rolling off.

It is another object of the present invention to provide a decorative golf ball that can be used to advertise the company logos, trademarks, promotion labels, etc. printed on golf balls.

It is still an object of the present invention to provide a decorative golf ball with a magnet insert such that it can be removably secured to metallic surfaces or flat surfaces, thereby to display the company logos or other printed materials on golf ball.

It is another object of the present invention to provide a decorative golf ball that can be used as a paperweight.

It is still another object of the present invention to provide a decorative golf ball with a magnet insert to secure a piece of paper on a vertical magnetic surface, such as on a refrigerator door.

These and other objects of the present invention will become apparent from the following detailed description.

BRIEF DESCRIPTION OF THE DRAWINGS

FIG. 1 is a bottom perspective view of a decorative golf ball made in accordance with the present invention.

FIG. 2 is a top perspective view of the decorative golf ball of FIG. 1 showing the ball logo.

FIGS. 3 and 4 are cross-sectional views showing the various steps in drilling a hole in a standard golf ball.

FIG. 5 is a cross-sectional view of the golf ball of FIG. 1 using the cutting tool of FIG. 3.

FIG. 6 is a cross-sectional view showing a different cutting tool for creating a hole in the golf ball.

FIG. 7 is cross-sectional view of the golf ball of FIG. 1 using the cutting tool of FIG. 6.

FIGS. 8 and 9 are cross-sectional view showing different cutting tools for creating the hole in the golf ball.

FIG. 10 is a cross-sectional view of the golf ball of FIG. 1 using the cutting tools of FIG. 8 and 9.

FIG. 11 is a perspective view of a clamping fixture used in holding the golf ball during the drilling step.

FIG. 12 is an exploded view of the clamping fixture of FIG. 11, with one member shown secured to a drill press.

FIGS. 13 and 14 are cross-sectional view showing a method for pressing the magnet into the hole in the golf ball.

FIG. 15 is a cross-sectional view of a decorative golf ball made from the process shown in FIGS. 13 and 14.

FIG. 16 is a cross-sectional view of a decorative golf ball made in accordance with the present invention, showing the magnet partly recessed into the golf ball.

FIG. 17 is a cross-sectional view of a decorative golf vall showing yet another means for securing the magnet to the golf ball.

FIG. 18 is a cross-sectional view of a decorative golf ball in accordance with the present invention, showing another means for securing the magnet to the golf ball.

DETAILED DESCRIPTION OF THE INVENTION

A decorative golf ball R made in accordance with the present invention is disclosed in FIG. 1. The ball R comprises a standard golf ball 2 with a flat surface 4 disposed diametrically opposite a company logo, trademark or other indicia 6, as best shown in FIG. 2. The flat surface 4 enables the golf ball 2 to be displayed on a horizonal flat surface without rolling off.

The decorative golf ball R is made by cutting a hole 8 into the golf ball 2 by means of a hole saw 10, as best shown in FIGS. 3 and 4. The hole 8 is then filled with epoxy up to a level 14 below the lip 16 of the hole 8. A plug or magnet 18 is then pressed into the hole 8 and secured to the epoxy 12, as best shown in FIG. 5. The magnet 18 has the flat surface 4.

A one inch twist drill bit 20 may also be used to create a hole 22 in the golf ball 2, as best shown in FIG. 6. Hot-melt glue 24 is used to retain the magnet 18 in the hole 22, as best shown in FIG. 7.

A single edge Stanley hole cutter 26 may be used to create a hole 28 in the golf ball 2, as best shown in FIG. 8. A double-edge Black and Decker hole cutter 30 may be used to create the hole 28. Using either the cutter 26 and 30 advantageously provided cleaner hole 28, with minimum deburring of the lip edge 16. Silicone adhesive 32 is used to secure the magnet 18 within the hole 28, as best shown in FIG. 10.

A clamping fixture 34 is used to hold the ball 2 during the drilling step. The fixture 34 advantageously prevents ball distortion from the clamping force, thereby permitting a clean hole to be made, without excessive burss along the lip edge 16. The fixture 34 comprises a mainframe 36 with a cylindrical groove 38 that is adapted to receive the golf ball 2 in a closed fit. A "U"-shaped clamping member 40 is secured to the main frame 34 by means of socket screws 42, as best shown in FIG. 11. The clamping member 40 holds the ball immobile within the cylindrical groove 38 during the drilling process.

The clamping fixture 34 is advantageously used in conjunction with a bench-type drill press 42, as best shown in FIG. 12. The fixture 34 is secured to the drill press table 44 such that the cylindrical groove 38 is centered around the opening 46 which is aligned with the axis of rotation and vertical travel of the drill bit. A mirror 48 is disposed below the table 44 and the opening 46. The mirror 48 is used advantageously to center the logo 6 in the opening 46 such that the logo 6 is diametrically opposite the drill bit and hence the hole that will receive the magnet 18.

A steel plate 50 may be used for inserting the magnet 18 into the hole 28, as best shown in FIG. 13. The adhesive 32 secures the magnet 18 in place. The golf ball 2 is clamped to the plate 50 while the adhesive sets and to create a lip edge 52 that extends beyond the flat surface 4 of the magnet 18, as best shown in FIG. 15. Thus, a shallow recess 54 is created, providing a gap between the magnet and the metallic surface to which the ball is attached, thereby protecting the finish on the metallic surface.

By reducing the diameter of the hole 28 slightly, the magnet 18 may be press fit into the hole, eliminating the need for adhesive.

A plastic label may be glued to the exposed surface 4 of the magnet 18 to provide improved appearance and to advantageously prevent scratching of the finish of the metallic surface to which the decorative golf ball R may be secured.

The magnet 18 may extend beyond the hole 28 and the periphery of the ball 2, as best shown in FIG. 16. A protective coating 56 disposed on the exposed surfaces of the magnet 18 advantageously reduces scratching of furniture finish. The coating 56 may include paint, plastic, etc.

Where future use of the ball 2 is desired, the magnet 18 may be removably secured to the ball 2 by means of a temporary adhesive 58, as best shown in FIG. 17. A protective cover 60 is disposed around the magnet 18 and the adhesive 58.

An external mounting support 62 secured to the ball 2 is disclosed in FIG. 18. The support 62 includes a recess 64 in which the magnet 18 is secured. A wood screw 66 mounts the support 62 to the ball 2. A protective coating 68 is disposed on the exposed surface of the magnet 18 to provide scratch protection to furniture finish.

The magnet 18 is preferably one inch in diameter by one-quarter inch thick to add substantial weight to the ball 2. The magnet 18 may be a permanent ceramic magnet.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A decorative device, comprising:

a) a golf ball including a recess;

b) a magnet plug disposed within said recess to permit said golf ball to be removably secured to a metallic surface;

c) said magnet plug including an exposed flat surface to permit said golf ball to be placed on a flat support surface without rolling off; and d) said golf ball including an indicia disposed opposite said magnet plug such that said indicia is visible when said golf ball is secured to the metallic surface or flat support surface for display.

2. A decorative device as in claim 1, wherein:

a) said recess includes an outer lip edge extending beyond said flat surface of said magnet plug.

3. A decorative device as in claim 2, wherein:

a) said golf ball includes an outer surface; and b) said magnet extends beyond said lip edge and said outer surface of said golf ball.

4. A decorative device as in claim 1, wherein:

a) said magnet plug is press-fit into said recess.

5. A decorative device as in claim 1, wherein:

a) said magnet plug is secured by adhesive within said recess.

6. A decorative device as in claim 1, wherein:

a) said flat surface of said magnet plug includes a protective coating.

7. A decorative device as in claim 1, wherein:

a) said indicia is disposed diametrically opposite said magnet plug.

* * * * *